US005609319A

United States Patent [19]

Kelley

[11] Patent Number: 5,609,319

[45] Date of Patent: Mar. 11, 1997

[54] LOTTO TICKET HOLDER

[76] Inventor: Daniel W. Kelley, 957 Tamarack Trail, Forest Park, Ga. 30050

[21] Appl. No.: 547,128

[22] Filed: Oct. 24, 1995

[51] Int. Cl.[6] ..... A47G 1/10; B42D 15/02

[52] U.S. Cl. ..... 248/316.7; 248/206.5; 40/600; 40/642.02

[58] Field of Search ..... 248/206.5, 49, 248/174; 40/124.1, 600, 773, 711

[56] References Cited

U.S. PATENT DOCUMENTS 4,909,383 3/1990 Gross ..... 206/39

5,275,285 1/1994 Clegg ..... 40/124.1 X

*Primary Examiner*—Leslie A. Braun
*Assistant Examiner*—Long Dinh Phan
*Attorney, Agent, or Firm*—Joseph H. McGlynn

[57] ABSTRACT

A card with magnetic strips on the back of the card mount the card on a metallic, vertical surface. The front of the card contains a bifurcated holder in the shape of a wish bone which is anchored at one end to the card. The central portion of the wish bone has a resilient band to hold the free end of the wish bone against the card. By slipping a lottery ticket between the free end of the wish bone and the card, a lottery ticket will be safely stored against loss.

7 Claims, 1 Drawing Sheet

FIG.1
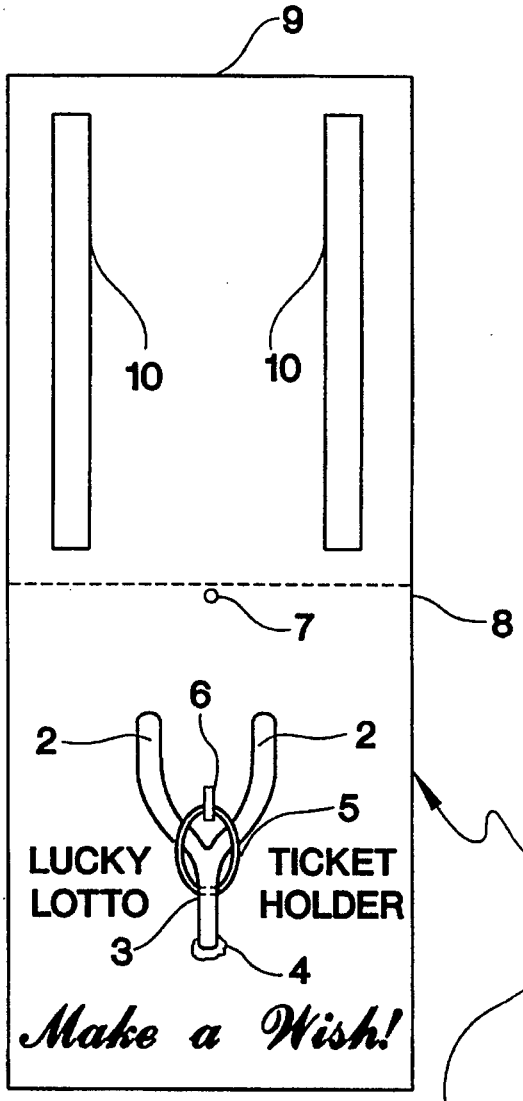
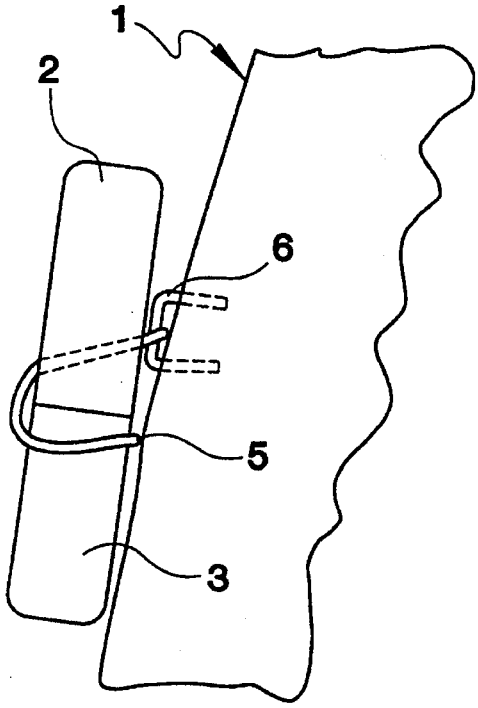
FIG.2
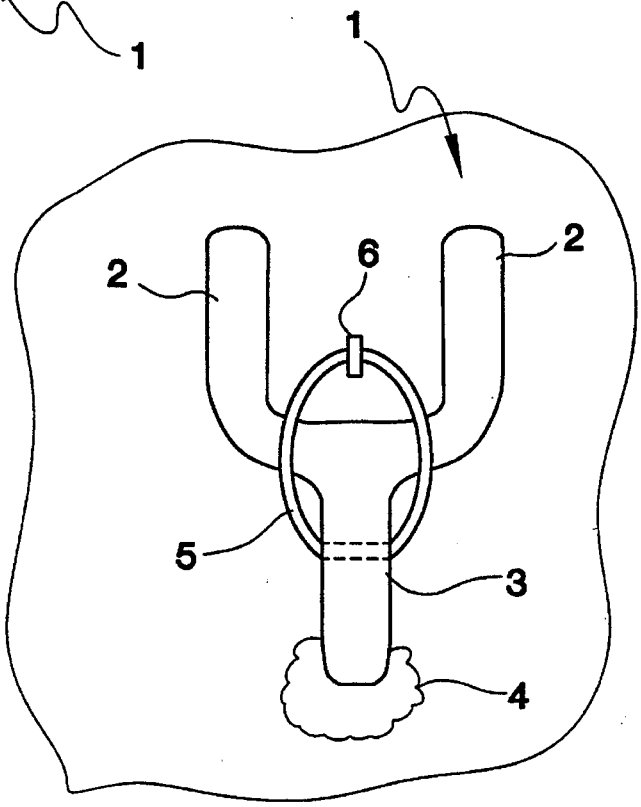
FIG.3

LOTTO TICKET HOLDER

BACKGROUND OF THE INVENTION

This invention relates, in general, to a lottery ticket holder, and, in particular, to a lottery ticket holder that may be magnetically attached to any metal object, or may be placed by any appropriate attaching means to a bulletin board, or may be hung over a wall protrusion such as a nail or screw.

DESCRIPTION OF THE PRIOR ART

In the prior art various types of lottery aids have been proposed. For example, U.S. Pat. No. 4,662,518 discloses a container which can hold lottery tickets and which also contains a scraper designed to remove the coatings from the scratch type of tickets, a protective lip which covers the "void if removed" section of the ticket and a slot for easy disposal of the residue coating. U.S. Pat. No. 4,739,877 discloses a combination key ring and card holder. U.S. Pat. No. 4,909,383 discloses a lottery ticket holder with two compartments. The first holds an elongated flat lottery slip and the second holds a truncated flat lottery ticket. U.S. Pat. No. 5,127,720 discloses a lottery scratch tray combined with a scratch means for removing the coating on a ticket and a slot for easy removal of the residue coating.

SUMMARY OF THE INVENTION

The present invention has a card with magnetic strips on the back of the card to mount the card on a metallic, vertical surface. The front of the card contains a bifurcated holder in the shape of a wish bone which is anchored at one end to the card. The central portion of the wish bone has a resilient band to hold the free end of the wish bone against the card. By slipping a lottery ticket between the free end of the wish bone and the card, a lottery ticket will be safely stored against loss.

It is an object of the present invention to provide a holder for lottery tickets that is inexpensive to manufacture.

It is an object of the present invention to provide a holder for lottery tickets that can be mounted on a highly visible surface to avoid losing lottery tickets.

It is an object of the present invention to provide a holder for lottery tickets that will securely hold lottery tickets.

These and other objects and advantages of the present invention will be fully apparent from the following description, when taken in connection with the annexed drawings.

BRIEF DESCRIPTION OF THE DRAWINGS

FIG. 1 is a plan view of the present invention.

FIG. 2 is a side view of the present invention.

FIG. 3 is a front view of the wish bone holder of the present invention.

DESCRIPTION OF THE PREFERRED EMBODIMENT

Referring now to the drawings in greater detail, FIG. 1 shows a plan view of the lottery ticket holder of the present invention. The holder consists of a card 1 that can be made from, but not limited to, heavy cardboard or plastic. Attached to the card 1 is a pair of magnetic strips 10 at one end of the card. At the other end of the card is a holder 5 with two arms 2 diverging away from a center arm 3 in the shape of a "Y" or a wish bone. The holder 5 is permanently fastened at the end of the central arm 3 by a blob of silicone adhesive 4 to create a resilient hinge. Silicone adhesive has been selected since it remains pliable after it cures and will allow a slight amount of movement of the end of arm 3 as the upper end of the wish bone is moved toward and away from the card 1. Obviously, silicone is not the only adhesive that can be used with the present invention. Any adhesive that remains relatively flexible after it sets can be used without departing from the scope of the invention.

Between the arms 2, a staple 6 is attached to the card 1 to hold a rubber band 5 or similar article, as shown in FIGS. 2 and 3. The rubber band 5 is looped around the arm 3 and then passed between the arms 2 and fastened with the staple 6.

The card 1 can have a fold line 8 positioned approximately in the middle of the card, which will make it easier to fold the card so the magnetic strips 8 are on the back of the card. The card can then be pressed against a metallic, vertical surface where the strips 10 will hold it securely.

The fold line can also be used to help form a tent-like structure so the card can be placed on a horizontal surface in the manner of a place card, if a vertical surface is not convenient.

In order to use the ticket holder, the card is folded along the line 8 and placed on a vertical surface and held by the magnetic strips 10, or placed on a horizontal surface and supported by the edges 9 and 11. The lottery ticket is then placed between the upper arms 2 of the wish bone where it will be securely held by the resiliency of the rubber band 5. Now a lottery player knows where he or she has placed their lottery tickets and will not have to worry about losing what might be a winning ticket.

Also, even though the holder of the present invention has been described as a holder for lottery tickets, it should be understood that it may be used to hold other items. For example, it can be used to hold notes, recipe cards, telephone messages, grocery lists, or any similar item.

Although the lottery ticket holder and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A holder for flat articles comprising:

a flat card of rectangular configuration, said card having a top portion and a bottom portion, said top portion of said card having a mounting means for mounting said card on a vertical surface, said bottom portion having a Y-shaped element attached thereto, said Y-shaped element having a vertical arm and two arms diverging from said vertical arm, means for attaching said Y-shaped element to said card at a bottom of said vertical arm, resilient means having one end attached to said Y-shaped element below the point where said two arms diverge, means for attaching another end of said resilient means to said card, whereby a flat article may be secured between said diverging arms and said flat card.

2. The holder for flat articles as claimed in claim 1, wherein said card has a fold line means approximately midway between said top portion and said bottom portion for allowing said card to be folded thereby placing said mounting means on one side of said card and said Y-shaped element on an opposite side of said card.

3. The holder for flat articles as claimed in claim 1, wherein said resilient means is a rubber band.

4. The holder for flat articles as claimed in claim 1, wherein said means for attaching another end of said resilient means to said card is a U-shaped element and said resilient means is attached to a bottom part of said U-shaped element.

5. The holder for flat articles as claimed in claim 1, wherein said mounting means for mounting said card on a vertical surface is at least one magnet.

6. The holder holder for flat articles as claimed in claim 1, wherein said mounting means for mounting said card on a vertical surface is a pair of magnetic strips.

7. The holder for flat articles as claimed in claim 1, wherein said means for attaching said Y-shaped element to said card is silicone adhesive.

* * * * *